US007658790B1

(12) United States Patent
Gorer et al.

(10) Patent No.: US 7,658,790 B1
(45) Date of Patent: Feb. 9, 2010

(54) CONCENTRATED ELECTROLESS SOLUTION FOR SELECTIVE DEPOSITION OF COBALT-BASED CAPPING/BARRIER LAYERS

(75) Inventors: Alexander Gorer, Los Gatos, CA (US); Tony Chiang, Campbell, CA (US); Chi-I Lang, Sunnyvale, CA (US)

(73) Assignee: Intermolecular, Inc., San Jose, CA (US)

( * ) Notice: Subject to any disclaimer, the term of this patent is extended or adjusted under 35 U.S.C. 154(b) by 255 days.

(21) Appl. No.: 11/773,316

(22) Filed: Jul. 3, 2007

(51) Int. Cl.
*C23C 18/34* (2006.01)

(52) U.S. Cl. ..... 106/1.22; 106/1.27

(58) Field of Classification Search ..... 106/1.22, 106/1.27

See application file for complete search history.

(56) References Cited

U.S. PATENT DOCUMENTS 6,638,564 B2 * 10/2003 Segawa et al. ..... 427/8
6,645,567 B2 * 11/2003 Chebiam et al. ..... 427/443.1
6,821,324 B2 * 11/2004 Shacham-Diamand et al. ... 106/1.22
6,902,605 B2 * 6/2005 Kolics et al. ..... 106/1.22
7,332,193 B2 * 2/2008 Valverde et al. ..... 427/99.5
7,410,899 B2 * 8/2008 Chen et al. ..... 438/678
2004/0038073 A1 * 2/2004 Chebiam et al. ..... 428/668
2004/0134375 A1 * 7/2004 Kolics et al. ..... 106/1.22
2005/0008786 A1 * 1/2005 Dubin et al. ..... 427/421.1
2005/0095830 A1 * 5/2005 Weidman et al. ..... 438/584
2005/0136193 A1 * 6/2005 Weidman et al. ..... 106/1.27
2005/0161338 A1 * 7/2005 Fang et al. ..... 205/176

* cited by examiner

*Primary Examiner*—Helene Klemanski

(57) ABSTRACT

An electroless solution for deposition of a cobalt-based alloy on a substrate is provided. The electroless solution may be formed by mixing first and second solutions, with the first and second solutions being prepared from concentrated precursors. In one embodiment, the first solution contains a cobalt (Co) ion source and a complexing and deposition selectivity agent. In one embodiment, the cobalt concentration in the first solution is at least 90 millimoles per liter. The second solution contains a reducing agent. In one embodiment, the reducing agent is dimethylamineborane (DMAB) having a concentration of at least 10 grams per liter. In other embodiments, the first solution also contains a tungsten (W) ion source, and either the first or second solution also contains a phosphorous (P) ion source.

18 Claims, No Drawings

CONCENTRATED ELECTROLESS SOLUTION FOR SELECTIVE DEPOSITION OF COBALT-BASED CAPPING/BARRIER LAYERS

BACKGROUND

The present invention relates generally to semiconductor devices and, more particularly, to a concentrated electroless solution for selective deposition of cobalt and cobalt-based alloys onto a copper surface.

In ultra-large-scale integration (ULSI) microelectronic devices, copper (Cu) has almost completely replaced aluminum (Al) in the fabrication of interconnects. Those skilled in the art are familiar with the advantages of using copper instead of aluminum; however, there are problems associated with the use of copper. These problems include corrosion, weak adhesion, high chemical reactivity, and diffusion of copper into silicon (Si). One of the approaches used to overcome the electromigration or corrosion problems associated with copper is to form a capping/barrier layer by electroless deposition.

U.S. Pat. No. 6,902,605 B2 to Kolics et al. discloses an electroless solution for deposition of a cobalt (Co)-tungsten (W)-phosphorous (P)-boron (B) film onto a copper surface to form a capping/barrier layer. This solution has shown potential when used to form a capping/barrier layer on silicon wafers that use silicon oxide as a dielectric to insulate the copper interconnections from one another.

As the density of ULSI devices has increased, manufacturers have started to use a much wider variety of materials in ULSI fabrication. For example, different manufacturers might use completely different chemicals at the same stages of device fabrication. Further, different manufacturers might use different types of dielectric materials to insulate the copper interconnections from one another. As a result of these differences, an electroless chemistry that works in the fabrication of one device might not be useful in the fabrication of another device.

Silicon carbonitride-based dielectrics have shown promise in the fabrication of increasingly dense ULSI devices. When known electroless solutions (e.g., the solution disclosed by Kolics et al.) have been used to deposit a cobalt-based capping/barrier layer onto copper interconnections having a silicon carbonitride-based dielectric, cobalt particles have been deposited without selectivity on both the copper and the dielectric. This is highly undesirable because it causes short circuits in the electronic device.

Thus, in view of the foregoing, a need exists for an electroless solution for the deposition of cobalt-based alloys onto a copper surface that can be used in a wide range of conditions and with a wide range of dielectric materials, including silicon carbonitride-based dielectric materials.

SUMMARY

Broadly speaking, the present invention fills these needs by providing an electroless solution for the deposition of cobalt-based alloys onto a copper surface that can be used in a wide range of conditions and with a wide range of dielectric materials. It should be appreciated that the present invention can be implemented in numerous ways, including as a solution and as a method of using the solution. Several inventive embodiments of the present invention are described below.

In one aspect of the invention, an electroless solution for depositing a cobalt-based alloy on a substrate is provided. The electroless solution may be formed by mixing a first solution and a second solution. In one embodiment, the first solution contains a cobalt (Co) ion source and a complexing and deposition selectivity agent. In one embodiment, the cobalt concentration in the first solution is at least 90 millimoles per liter. The second solution contains a reducing agent. In one embodiment, the reducing agent is dimethylamineborane (DMAB) having a concentration of at least 10 grams per liter. In other embodiments, the first solution also contains a tungsten (W) ion source, and either the first or second solution also contains a phosphorous (P) ion source.

It is to be understood that the foregoing general description and the following detailed description are exemplary and explanatory only and are not restrictive of the invention, as claimed.

DETAILED DESCRIPTION OF EXEMPLARY EMBODIMENTS

Embodiments of the present invention provide for the electroless deposition of cobalt (Co) and cobalt-based alloys onto different types of copper (Cu)-based surfaces. In particular, embodiments of the present invention provide a concentrated, activation-free solution that permits the selective and conformal electroless deposition of cobalt and cobalt-based alloys on a wide range of surfaces, including silicon wafers having copper interconnections that are electrically insulated from one another by silicon carbonitride-based dielectric materials. In contrast, conventional electroless deposition solutions, which have diluted chemistries relative to the concentrated chemistries described herein, typically work for just one set of copper interconnections and dielectric material, and do not permit selective deposition on silicon carbonitride-based dielectric materials. As these solutions deposit materials on the dielectric surface, brush scrubbers are typically used to remove the particles from the dielectric surface. The electroless solution of the present invention lessens or eliminates the need to use brush scrubbers to remove particles from the dielectric surface.

In one embodiment, an electroless solution for depositing a cobalt (Co)-based alloy on a substrate is provided. In this embodiment, the electroless solution is formed by mixing a first solution and a second solution. The first solution includes a cobalt ion source and a complexing and deposition selectivity agent. The cobalt ion source may be any suitable soluble cobalt salt. Examples of suitable cobalt salts include cobalt acetate, cobalt chloride, cobalt chloride, cobalt hydroxide, cobalt nitrate, cobalt sulfate, and cobalt sulfate heptahydrate.

The complexing and deposition selectivity agent serves two functions. The first function is a complexing function in which ionic compounds are formed with the metal being deposited to avoid precipitation of the metal in the solution. The second function is a deposition selectivity function in which the pH of the solution is adjusted to within the range required for selective deposition. Those skilled in the art will appreciate that other parameters such as, for example, temperature, also contribute to selective deposition. In one embodiment, the complexing and deposition selectivity agent is selected from among citric acid, ammonium chloride, ammonium citrate, 3 Na-citrate, 3 $NH_4$-citrate, acetic acid, ethylenediamine, sodium citrate dihydrate, tetramethylammonium hydroxide (TMAH), and combinations thereof.

The second solution is comprised of a suitable reducing agent. The reducing agent enables the deposition of neutral metal ions on the surface of the substrate. Examples of suitable reducing agents include boric acid, sodium hypophosphite ($NaH_2PO_2$), borohydrides, and alkyl borane compounds. In one embodiment, the borohydride is one of $NaBH_4$, $KBH_4$, cyanoborohydride ($NaBH_3CN$), sodium trimethoxyborohydride ($NaBH(OCH_3)_3$), and tetramethylammonium borohydride. In one embodiment, the alkyl borane compound is dimethylamineborane (DMAB), which can also serve as a boron (B) ion source.

To obtain desired cobalt-based alloys, additional metal ion sources may be included in the first and second solutions. For example, a tungsten (W) ion source can be included in the first solution. The tungsten ion source may be any suitable tungsten compound. In one embodiment, the tungsten ion source is phosphotungstic acid (12 $WO_3.H_3PO_4 \times H_2O$). Other examples of suitable tungsten ion sources include tungstic acid, sodium tungsten dihydrate, and ammonium tungstate. Further, either the first solution or the second solution can include a phosphorous (P) ion source. The phosphorous ion source can be included in the second solution because it may also function as a reducing agent which reduces the metal ions in the solution into a layer of metal on the surface of the substrate. In one embodiment, the phosphorous ion source is hypophosphorous acid ($H_3PO_2$). Another example of a phosphorous ion source is sodium hypophosphite ($NaH_2PO_2$).

To obtain the desired degree of concentration in the electroless solution, the first solution and the second solution may be prepared from concentrated precursors. Examples of suitable concentrated precursors are shown below in the Examples. In one embodiment, the first solution is formulated to have a cobalt (Co) concentration of at least 90 millimoles per liter (the solubility limit is approximately 185 millimoles per liter). In another embodiment, the first solution is formulated to have a cobalt (Co) concentration of 110 millimoles per liter. Once the first solution and the second solution have been prepared, the electroless solution may then be formed by mixing the first solution and the second solution. In one embodiment in which the second solution is comprised of DMAB, the electroless solution is formulated to have a DMAB concentration of at least 10 grams per liter. In another embodiment, the electroless solution is formulated to have a DMAB concentration of 110 grams per liter.

As noted above, the electroless solution may be formed by mixing the first solution and the second solution. To ensure that the electroless solution results in the deposition of thin films having a stable composition, the pH of the first solution is adjusted to a pH level in the range from 8.9 to 10. In one embodiment, the pH of the first solution is adjusted to a pH level in the range from 9.3 to 9.6.

The procedure for carrying out an electroless deposition using the electroless solution may be as follows. To start, the first solution is preheated to a temperature within the range of 40 degrees C. to 100 degrees C. In one embodiment, the first solution is preheated to a temperature of approximately 80 degrees C. Next, unheated, i.e., cold, second solution is added to the preheated first solution. Alternatively, the first and second solutions can be cold mixed and then heated by, e.g., rapid thermal heating, but rapid preheating is preferred because reactivity can be lost if the solution is heated for too long. The volume ratio of the first solution to the second solution may be varied to obtain the desired formulation of the electroless solution. In one embodiment, the volume ratio of the first solution to the second solution is in the range from 1:1 to 10:1. Next, the mixture of the first solution and the second solution (i.e., the electroless solution) is heated again. In one embodiment, the mixture is heated back up to approximately 80 degrees C. Next, the heated electroless solution is poured onto a hot substrate. The solution is left on the substrate for a specified period of time, which is selected depending upon the desired thickness of the deposition. In one embodiment, the specified period of time is in the range from approximately 10 seconds to approximately 2 minutes. Finally, when the specified period of time is up, the substrate is quenched with cold water and the electroless solution is thoroughly rinsed away.

The formulation of the electroless solution may be varied to meet the needs of particular situations. By way of example, the ratios of the other components in the solution may be varied relative to the amount of cobalt in the solution. In embodiments of the present invention, the first solution may be formulated such that the molar ratio of citric acid to cobalt is in the range from 1.5 to 4.5, the molar ratio of ammonium chloride to cobalt is in the range from 4.5 to 12, the molar ratio of phosphotungstic acid to cobalt is in the range from 1.25 to 5, and the molar ratio of hypophosphorous acid to cobalt is in the range from 1 to 3. When the second solution is comprised of DMAB, the relative amounts of the first solution and the second solution may be selected such that the molar ratio of DMAB to Co in the electroless solution is in the range from 2.1 to 32.8.

The electroless solution will now be described in terms of specific examples. It should be borne in mind that the examples given below are merely illustrative of particular applications of the solution and should in no way be construed to limit the usefulness of the solution in other applications.

EXAMPLES

Example 1

An exemplary electroless solution for the electroless deposition of a Co—W—P—B layer was prepared in the following manner. In this example, the cobalt (Co) ion source used was cobalt sulfate, the tungsten (W) metal ion source used was phosphotungstic acid (12 $WO_3.H_3PO_4 \times H_2O$), and the phosphorous (P) ion source used was hypophosphorous acid ($H_3PO_2$).

First, the following concentrated precursors were made: a 1.9 M concentrated solution of cobalt sulfate; a 5 M concentrated solution of ammonium chloride; a 3.6 M concentrated solution of citric acid; a 25 weight % solution of tetramethylammonium hydroxide (TMAH) in $H_2O$; a 0.1 M concentrated solution of phosphotungstic acid in TMAH; concentrated hypophosphorous acid; and 1.8 M concentrated dimethylamineborane (DMAB).

Next, approximately one liter of a first solution called solution A was prepared using the appropriate concentrated precursors. Solution A was prepared by mixing 63 ml of cobalt sulfate solution, 100 ml of citric acid solution, 590 ml of TMAH, 216 ml of ammonium chloride solution, 30 ml of phosphotungstic acid in TMAH, and 25 ml of concentrated hypophosphorous acid. When the thus-formed solution cooled down to room temperature, the pH level of the solution was adjusted to a pH of 9.3 to 9.6 by adding TMAH drop by drop.

Next, a second solution called solution B was prepared by preparing a 1.8 M solution of DMAB.

The electroless solution was then prepared in the following manner using solutions A and B. Solution A was preheated to approximately 80 degrees C. Cold solution B was then added to the preheated solution A. In this example, the volume ratio of solution A to solution B was 1:1. The electroless solution comprised of the mixture of solution A and solution B was then heated back up to approximately 80 degrees C. Once the solution reached approximately 80 degrees C., the solution was used in an electroless deposition process within a relatively short period of time.

The electroless solution was used to deposit a Co—W—P—B layer on a number of TEOS and SiCN wafers (60 second deposition at pH=9.5). In each case, the Co—W—P—B layer was deposited without generating any significant amount of particles on the dielectric surface.

Example 2

An electroless solution was prepared in accordance with the procedure set forth above in Example 1, with the exception that the volume ratio of solution A to solution B was 2.5:1. This electroless solution was used to deposit a Co—W—P—B layer on a number of TEOS and SiCN wafers (60 second deposition at pH=9.5). In each case, the Co—W—P—B layer was deposited without generating any significant amount of particles on the dielectric surface.

Comparative Example 1

An electroless solution was prepared in accordance with the procedure set forth above in Example 1, with the exception that the procedure was modified such that the cobalt (Co) concentration in Solution A was 65 millimoles per liter. This electroless solution was used to deposit a Co—W—P—B layer on a number of SiCN wafers (60 second deposition at pH=9.6). In each case, the deposition of the Co—W—P—B layer generated a significant amount of particles on the dielectric surface.

The electroless solution of the present invention enables the selective and conformal electroless deposition of cobalt and cobalt-based alloys to form a capping/barrier layer on a wide range of surfaces, including silicon wafers having copper interconnections that are electrically insulated from one another by silicon carbonitride-based dielectric materials. At present, the aspect ratio of the typical feature in which cobalt or a cobalt-based alloy is to be deposited is high enough, e.g., approximately 10-1, that the inclusion of a surfactant in the solution is not required. Features having lower aspect ratios, e.g., approximately 3-1, may require the use of a surfactant in the solution to obtain conformal deposition. By way of example, one suitable surfactant is RE610 (nonylphenol $P_2O_5$ phosphate).

The exemplary embodiments and examples described herein focus on the electroless deposition of a Co—W—P—B layer. It will be apparent to those skilled in the art that the electroless solution described herein can be used to deposit a layer of other cobalt-based alloys such as, for example, Co—P—W, Co—Mo—P—W, and Co—Mo—P—W—B. In the case of an alloy containing molybdenum (Mo), the molybdenum ion source may comprise any suitable soluble salt of molybdenum, e.g., sodium molybdate dihydrate ($Na_2MoO_4.2H_2O$). Suitable soluble salts of other metals, e.g., nickel (Ni) and chromium (Cr), also may be included in the solution to deposit cobalt-based alloys including these elements. In the case of nickel (Ni), one exemplary nickel salt is nickel sulfate hexahydrate ($NiSO_4.6H_2O$).

It will be apparent to those skilled in the art that additional materials may be included in the electroless solution as needed. For example, a buffer, e.g., boric acid ($H_3BO_3$) may be included to minimize or prevent fluctuation of pH when the solution is diluted. In addition, stabilizing materials such as thiourea ($SC(NH_2)_2$) and glycolic acid ($HOCH_2COOH$) may be included as preservatives.

One skilled in the art will appreciate that the solution described herein may be applied to hydrophobic low K dielectrics, which include Organosilicon compounds. The organosilicon compounds include organosilanes, siloxides, silyl hydrides, hydrosylilation compounds, silanes, and any other dielectric compound that includes carbon, silicon and hydrogen molecules. In one embodiment, the hydrophobic dielectrics are characterized by having a contact angle greater than 50 degrees. One skilled in the art will appreciate that organic species, e.g., carbon, are added to make the dielectric hydrophobic in order to prevent the adsorption of moisture, and it is also used for lowering the k value. The adsorption of moisture tends to increase the dielectric constant, which has negative implications for traditional dielectrics especially as feature sizes are shrinking.

It should be appreciated that the embodiments described above, including the examples eliminate the need to pre-activate the surface of the substrate in order to obtain the desired selectivity of the plating solution. That is, the surfaces of the substrates being plated are unactivated, which is commonly performed with palladium or by allowing the reducing agent, e.g., DMAB, to reside on the surface prior to adding the plating solution.

In addition, the assignee has found that as the concentration of the solution increases, i.e., the cobalt and/or the reducing agent concentration, the plating solution proceeds through various plating regimes. That is, as the concentration of the cobalt and/or the reducing agent in the plating solution moves to a more concentrated solution, the plating rate increases and the selectivity decreases. However, as the concentration further increases, e.g., the cobalt concentration becomes 90 millimoles per liter or greater and/or the DMAB concentration becomes 10 grams per liter or greater, the selectivity increases, rather than continuing to decrease, as would be expected.

In summary, the present invention provides a concentrated electroless solution for selectively depositing cobalt and cobalt-based alloys onto a copper surface. The invention has been described herein in terms of several exemplary embodiments. Other embodiments of the invention will be apparent to those skilled in the art from consideration of the specification and practice of the invention. The embodiments and preferred features described above should be considered exemplary, with the invention being defined by the appended claims and equivalents thereof.

What is claimed is:

1. A method for forming an electroless solution for depositing a cobalt-based alloy on a substrate, comprising:

forming a first solution comprised of a cobalt (Co) ion source and a complexing and deposition selectivity agent, the first solution having a cobalt (Co) concentration of at least 90 millimoles per liter and heating the first solution to a temperature in the approximate range of 40° C. to 100° C.;

forming an unheated second solution comprised of a reducing agent;

mixing the heated first solution and the unheated second solution to form the electroless solution, wherein the volume ratio of the first solution to the second solution is in the approximate range of 1:2 to 10:1; and heating the electroless solution to a temperature of approximately 80° C. immediately before application of the electroless solution to the substrate.

2. The method of forming the electroless solution of claim 1, wherein forming the second solution includes selecting the reducing agent from the group consisting of boric acid, a borohydride, and alkyl borane compounds.

3. The method of forming the electroless solution of claim 2, wherein the borohydride is tetramethylammonium borohydride.

4. The method of forming the electroless solution of claim 2, wherein the alkyl borane compound is dimethylamineborane (DMAB).

5. The method of forming the electroless solution of claim 1, wherein the cobalt (Co) ion source is selected from the group consisting of cobalt acetate, cobalt chloride, cobalt hydroxide, cobalt nitrate, cobalt sulfate, and cobalt sulfate heptahydrate.

6. The method of forming the electroless solution of claim 1, wherein the complexing and deposition selectivity agent is selected from the group consisting of citric acid, ammonium chloride, ammonium citrate, 3 $NH_4$-citrate, acetic acid, ethylenediamine, tetramethylammonium hydroxide (TMAH), and combinations thereof.

7. The method of forming the electroless solution of claim 6, wherein an amount of the complexing and deposition selectivity agent is such that a molar ratio of citric acid to cobalt (Co) in the electroless solution is in a range from 1.5 to 4.5.

8. The method of forming the electroless solution of claim 1, wherein either the first solution or the second solution further comprises a phosphorous (P) ion source.

9. The method of forming the electroless solution of claim 8, wherein the phosphorous (P) ion source is hypophosphorous acid, and an amount of hypophosphorous acid is such that a molar ratio of hypophosphorous acid to cobalt (Co) in the first solution is in a range from 1:1 to 3:1.

10. The method of forming the electroless solution of claim 1, wherein the first solution further comprises a tungsten (W) ion source.

11. The method of forming the electroless solution of claim 10, wherein the tungsten (W) ion source is selected from the group consisting of phosphotungstic acid, tungstic acid, and ammonium tungstate.

12. The method of forming the electroless solution of claim 11, wherein the tungsten (W) ion source is phosphotungstic acid, and an amount of phosphotungstic acid is such that a molar ratio of phosphotungstic acid to cobalt (Co) in the first solution is in a range from 1.25:1 to 5:1.

13. The method of forming the electroless solution of claim 1, wherein the first solution has a pH in a range from 8.9 to 10.

14. The method of forming the electroless solution of claim 1, wherein the first solution is mixed with the second solution so that the volume ratio of the first solution to the second solution is in the approximate range of 1:1 to 10:1.

15. A method for electrolessly depositing a cobalt based alloy on a substrate, comprising:

forming an electroless solution by mixing a first concentrated solution consisting essentially of cobalt sulfate, citric acid, TMAH, ammonium chloride, phosphotungstic acid, and hypophosphorous acid at a temperature of approximately 80° C. with a second concentrated solution consisting essentially of dimethylborane (DMAB) having a temperature of approximately 20° C.; and applying the electroless solution to a patterned surface of the substrate, the patterned surface of the substrate having copper interconnection separated by a silicon carbonitride-based dielectric; and depositing the cobalt based alloy comprising cobalt, tungsten, phosphorous, and boron.

16. The method of claim 15, wherein the ratio of the first solution to the second solution is 1:1.

17. The method of claim 15, wherein the pH of the electroless solution is approximately 9.5.

18. The method of claim 16, wherein the cobalt based alloy selectively deposits on copper surfaces wherein the temperature of the electroless solution when it is applied to the substrate is approximately 80° C.

* * * * *